US009192794B2

(12) United States Patent
Patil et al.

(10) Patent No.: US 9,192,794 B2
(45) Date of Patent: Nov. 24, 2015

(54) NOISE REDUCTION SYSTEM FOR SUPPLIED AIR RESPIRATOR

(71) Applicants: Swapnil Gopal Patil, Maharashtra (IN); Joseph Rodrigues, Cranston, RI (US); Joseph Venagro, Cranston, RI (US)

(72) Inventors: Swapnil Gopal Patil, Maharashtra (IN); Joseph Rodrigues, Cranston, RI (US); Joseph Venagro, Cranston, RI (US)

(73) Assignee: Honeywell International Inc., Morristown, NJ (US)

( * ) Notice: Subject to any disclaimer, the term of this patent is extended or adjusted under 35 U.S.C. 154(b) by 377 days.

(21) Appl. No.: 13/683,696

(22) Filed: Nov. 21, 2012

(65) Prior Publication Data

US 2014/0116445 A1 May 1, 2014

Related U.S. Application Data

(63) Continuation-in-part of application No. 13/683,013, filed on Nov. 21, 2012.

(30) Foreign Application Priority Data

Oct. 25, 2012 (IN) ..... 3286/DEL/2012

(51) Int. Cl.

| | |
|---|---|
| ***A62B 23/02*** | (2006.01) |
| ***A62B 7/10*** | (2006.01) |
| ***A62B 9/00*** | (2006.01) |

(52) U.S. Cl.

CPC ... *A62B 9/00* (2013.01); *A62B 7/10* (2013.01); *A62B 23/02* (2013.01)

(58) Field of Classification Search

CPC ..... A62B 18/08; A62B 17/04; A62B 17/00; A62B 18/00; A62B 18/006; A62B 18/082; A62B 18/025; A62B 18/084; A62B 23/02; A62B 23/00; A62B 18/02; A62B 19/00; A62B 7/10; A62B 18/10; A62B 7/00; A62B 9/04; B23P 17/00; B29C 63/22; B29C 45/14311

USPC ..... 128/201.22, 201.23, 201.25, 201.28, 128/201.19, 204.23, 205.12, 201.24, 128/207.12, 206.12, 206.15, 206.17, 128/206.22, 206.24, 206.28, 201.15, 857, 128/201.29, 205.25, 205.27, 205.29, 128/206.21, 206.23, 206.19; 2/9, 429, 434, 2/427

See application file for complete search history.

(56) References Cited

U.S. PATENT DOCUMENTS 2,529,106 A 11/1950 Schauweker
3,291,126 A * 12/1966 Messick ..... 128/201.29

(Continued)

FOREIGN PATENT DOCUMENTS

EP 1810648 A1 7/2007
WO 9741815 11/1997

OTHER PUBLICATIONS

Bullard 88VX™ Series Airline Respirator User Manual; 20 pages, 2012.

(Continued)

*Primary Examiner* — Annette Dixon
(74) *Attorney, Agent, or Firm* — Conley Rose, P.C.; Kristin Jordan Harkins

(57) ABSTRACT

Embodiments relate generally to noise reduction techniques and systems for use with supplied air respirators. Typical embodiments may comprise porous elements located within a respirator system operable to alter the air flow pattern through the system and therefore reduce noise created in the system. These porous elements might be located within an inhalation valve, a breathing hose and/or a muffler block housing of a respirator system.

20 Claims, 6 Drawing Sheets

(56) References Cited

U.S. PATENT DOCUMENTS

| | | | | | |
|---|---|---|---|---|---|
| 3,739,774 | A | * | 6/1973 | Gregory | 128/201.28 |
| 3,945,044 | A | | 3/1976 | McGee et al. | |
| 3,963,021 | A | | 6/1976 | Bancroft | |
| 4,076,373 | A | | 2/1978 | Moretti | |
| 4,127,130 | A | * | 11/1978 | Naysmith | 128/201.25 |
| 4,256,386 | A | | 3/1981 | Herbert | |
| 4,414,973 | A | | 11/1983 | Matheson et al. | |
| 4,494,538 | A | * | 1/1985 | Ansite | 128/205.25 |
| 4,542,538 | A | | 9/1985 | Moretti et al. | |
| 4,592,350 | A | * | 6/1986 | Maryyanek et al. | 128/206.17 |
| 4,648,394 | A | | 3/1987 | Wise | |
| 4,846,166 | A | | 7/1989 | Willeke | |
| 4,873,972 | A | | 10/1989 | Magidson et al. | |
| 4,886,058 | A | | 12/1989 | Brostrom et al. | |
| 4,930,539 | A | | 6/1990 | van Rooy | |
| 4,961,420 | A | | 10/1990 | Cappa et al. | |
| H863 | H | | 1/1991 | Kwiedorowicz et al. | |
| 4,989,598 | A | | 2/1991 | Berg et al. | |
| 5,299,448 | A | | 4/1994 | Maryyanek et al. | |
| 5,431,156 | A | | 7/1995 | Sundstrom | |
| 5,549,104 | A | | 8/1996 | Crump et al. | |
| 6,102,033 | A | | 8/2000 | Baribeau et al. | |
| 6,408,845 | B1 | | 6/2002 | Pereira et al. | |
| 7,293,560 | B2 | | 11/2007 | Dahrendorf et al. | |
| 7,464,705 | B2 | | 12/2008 | Tanizawa et al. | |
| 7,762,252 | B2 | | 7/2010 | Prete | |
| 7,975,688 | B1 | | 7/2011 | Truitt | |
| 8,028,695 | B2 | | 10/2011 | Acker et al. | |
| 8,176,913 | B2 | | 5/2012 | Ivory | |
| 8,402,966 | B2 | | 3/2013 | Morgan, III et al. | |
| 8,707,472 | B2 | | 4/2014 | Stachler et al. | |
| 2009/0194101 | A1 | | 8/2009 | Kenyon et al. | |
| 2009/0241965 | A1 | | 10/2009 | Sather et al. | |
| 2009/0266361 | A1 | | 10/2009 | Bilger et al. | |
| 2010/0287688 | A1 | | 11/2010 | Stachler et al. | |
| 2011/0036347 | A1 | | 2/2011 | Morgan, III et al. | |
| 2012/0152255 | A1 | | 6/2012 | Barlow et al. | |
| 2014/0115864 | A1 | | 5/2014 | Patil et al. | |
| 2014/0116429 | A1 | * | 5/2014 | Patil et al. | 128/201.12 |
| 2014/0116430 | A1 | | 5/2014 | Patil et al. | |

OTHER PUBLICATIONS rpb® nova 30, Ultra Performance, Heavy Industry Respirator, IS99001 Accredited Company; www.rpbsafety.com; 4 pages.

MSA The Safety Company: Advantage® 4000 Abrasi-Blast™ Respirator, Information Sheet, msanet.com, 8 pages, 2011.

Clemco; www.clemcoindustries.com, Job No. 2317-0506, Rev. C 0111; Apollo 600 Supplied-Air Respirator for Abrasive Blasting; 4 pages, 2011.

rpb® nova 3®, Ultra Performance, Heavy Industry Respirator, IS99001 Accredited Company; www.rpbsafety.com; 4 pages.

Bullard 88VX™ Series Airline Respirator User Manual; 20 pages, 2011.

PCT/US2011/044229; International Preliminary Report on Patentability and Written Opinion; Jan. 22, 2013; 6 pages.

* cited by examiner

NOISE REDUCTION SYSTEM FOR SUPPLIED AIR RESPIRATOR

CROSS-REFERENCE TO RELATED APPLICATIONS

This application is a continuation in part of U.S. patent application Ser. No. 13/683,013, entitled "Abrasive Blast Respirator", filed Nov. 21, 2012 in the U.S. Patent Office, which is incorporated herein by reference in its entirely to the extent it does not conflict with this disclosure.

This application claims priority to India Provisional Patent Application Serial No. 3286/DEL/2012 entitled "Noise Reduction System for Supplied Air Respirator", filed Oct. 25, 2012 in the India Patent Office.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Noise may be a concern for conventional supplied air respirators, due to governmental regulations, industry custom, and/or ergonomic concerns for worker safety and efficiency, for example. Conventional supplied air respirators may be quite noisy, and some proposed modifications to respirators might further increase noise issues. Applicants have, therefore, developed noise reduction system embodiments to help minimize noise concerns associated with supplied air respirators, as discussed herein.

SUMMARY

Aspects of the disclosure may include embodiments of a noise reduction system for use with a supplied air respirator comprising one or more of the following: an inhalation valve comprising a porous airflow element which alters the air flow through the valve without substantially restricting airflow; a (corrugated) breathing hose in fluid communication with the inhalation valve; and a muffler housing block in fluid communication with the breathing hose, wherein the inhalation valve may further comprise a stem and a cover, wherein at least a portion of the stem may be designed to maintain contact with the cover throughout movement of the valve to avoid fluttering of the valve; the breathing hose may comprise a porous airflow element that alters the air flow through the hose without substantially restricting airflow located in proximity to the interface of the breathing hose and the muffler housing block; the muffler housing block may comprise a porous plastic muffler; the muffler housing block may comprise a chamber designed to allow for a substantially straight air flow path through the muffler housing block; and the porous airflow elements reduce turbulence of the air flow, thereby reducing the noise created by the air flow. In an embodiment, the porous airflow element of the inhalation valve might comprise a felt material formed of nonwoven polyester (for example, with acrylic binder). In an embodiment, the porous airflow element of the hose might also comprise a felt material formed of nonwoven polyester. In an embodiment, the connection of the breathing hose and the inhalation valve at a first end of the breathing hose might comprise a swivel assembly, and the connection of the muffler block to a second end of the breathing hose might comprise a hose clamp.

Additional aspects of the disclosure may include embodiments of a noise-reducing supplied air respirator system comprising: an inhalation valve; and a breathing hose in fluid communication with the inhalation valve, wherein the inhalation valve may comprise a felt element which alters the air flow through the valve without substantially restricting airflow; and the breathing hose may comprise a felt element which alters the air flow through the breathing hose without substantially restricting airflow. In an embodiment, the system might further comprise a muffler housing block in fluid communication with the breathing hose, wherein the muffler housing block may comprise a porous muffler. In an embodiment, the felt element of the breathing hose may be located in proximity to the connection of the muffler housing block and the breathing hose. In an embodiment, the porous muffler may comprise a plastic material which has a working pressure up to about 200 PSIG and pressure drop of approximately 3.5 to 4.5 PSIG at 5 CFM. In an embodiment, the system might further comprise a muffler housing block in fluid communication with the breathing hose, wherein the muffler housing block may comprise at least one resonating chamber tuned to reduce noise created within the muffler housing block. In an embodiment, the felt elements may reduce the turbulence of the air flow, thereby reducing the noise caused by the air flow. In an embodiment, the inhalation valve might further comprise a stem and a cover, wherein at least a portion of the stem may be designed to maintain contact with the cover throughout movement of the valve to avoid fluttering of the valve. In an embodiment, the felt elements of the breathing hose and inhalation valve may comprise a nonwoven polyester material with thickness of about 0.040 to 0.060 inch and air permeability of about 220 to 400 CFM/Sq. ft. at 0.5 inch H2O.

Other aspects of the disclosure may include embodiments of a supplied air respirator with a noise reduction system comprising: an inhalation valve; and a breathing hose in fluid communication with the inhalation valve, wherein the inhalation valve may comprise a porous airflow element which alters the air flow through the valve without substantially restricting airflow; and the breathing hose may comprise a porous airflow element which alters the air flow through the breathing hose without substantially restricting airflow. In an embodiment, the porous airflow element of the inhalation valve may comprise a felt material formed of nonwoven polyester. In an embodiment, the porous airflow element of the breathing hose might comprise a felt material formed of nonwoven polyester. In an embodiment, the inhalation valve may be located on a face mask of the respirator. In an embodiment, the inhalation valve may comprise a biasing member operable to bias the valve toward a closed position if the air pressure in the breathing hose is not sufficient to open the valve. In an embodiment, the system might further comprise a muffler housing block in fluid communication with the breathing hose, wherein the muffler housing block may comprise a porous plastic muffler. In an embodiment, the muffler housing block might further comprise a chamber designed to allow for a substantially straight air flow path through the muffler housing block. In an embodiment, the inhalation valve might further comprise a stem and a cover, wherein at least a portion of the stem may be designed to maintain contact with the cover throughout movement of the valve to minimize fluttering.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
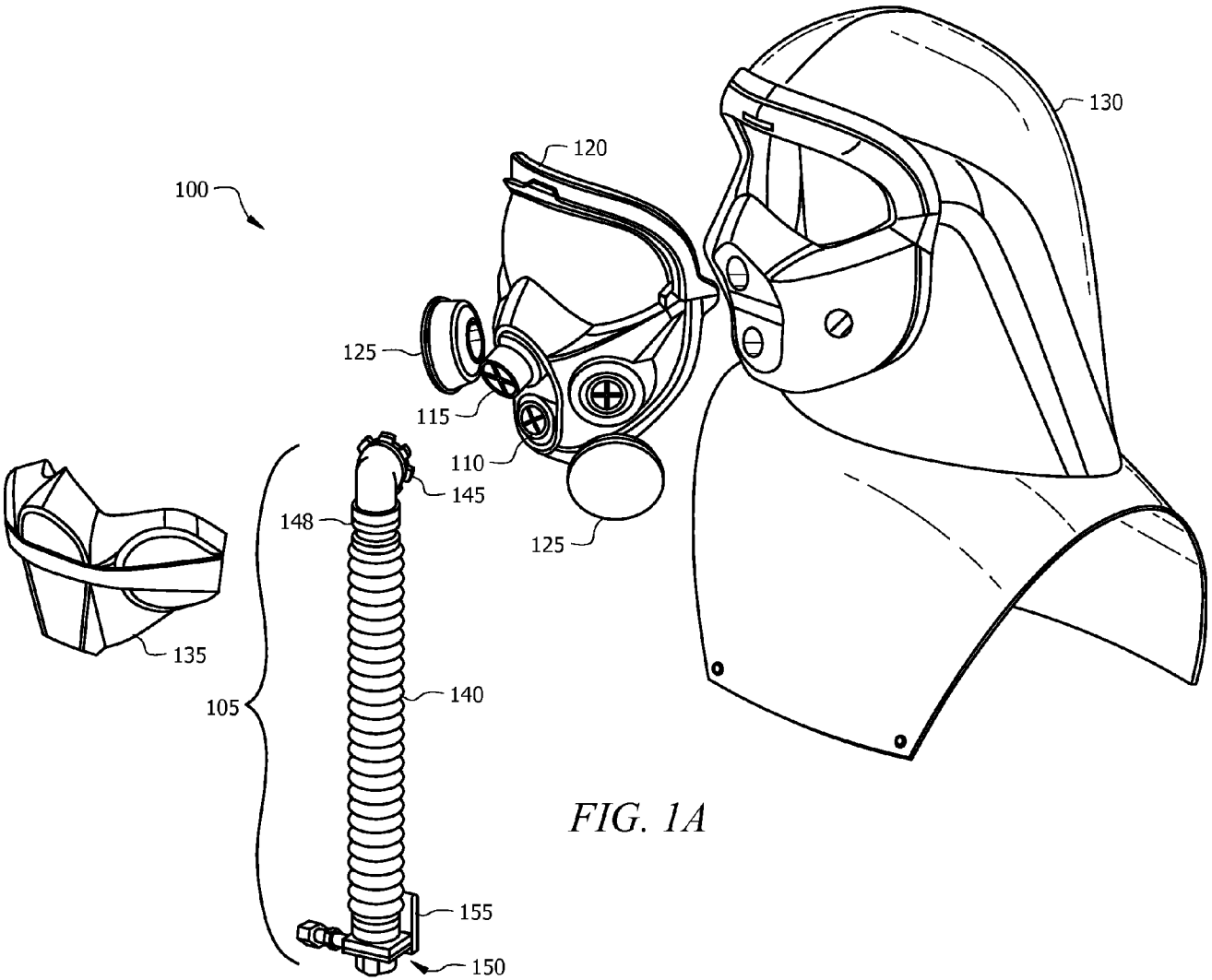
FIGS. 1A-1B illustrate two views of a respirator system comprising a noise reduction system therein according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments relate generally to noise reduction techniques and systems for use with a supplied air respirator. When a supplied air respirator is in use, noise may be created by the air flowing through different elements of the respirator as it is directed toward the face of a user. This noise may create a disturbance for the user, and noise exposure in certain work environments may be regulated by standards which may be based on decibels of sound and/or a certain length of time of exposure. For example, an inhalation valve may be provided as a part of the respirator system, and when air flows through the inhalation valve, noise may be created by the flow of air (for example, air exiting the valve). If the inhalation valve is located near the face of a user, such as on a face mask or facepiece of the respirator, the noise from the air flow through the valve may become a disturbance to a user (given the proximity of the noise source to the user, especially in an enclosed environment such as a respirator). Even if the inhalation valve is located elsewhere, such as the end of a breathing hose of the respirator, it may be still desired to lower the noise created by the air flow through the valve (even though distance may lessen the impact of the noise to some degree). By way of another example, a corrugated breathing hose may generate a whistling sound in some instances based on airflow, adding to noise generation during usage of a respirator. Applicants have developed noise reduction system embodiments which may serve to reduce the noise or sound level in a supplied air respirator by targeting specific sources of noise in various elements of the respirator system.

In an embodiment shown FIG. 1, a respirator system 100 may comprise an inhalation valve 110 incorporated into a facemask 120. The system 100 may also comprise a breathing hose 140 which may be in fluid communication with the inhalation valve 110, for example, via a swivel assembly 145 which may be attached to the breathing hose 140 with a clamp 148 (which may for example be a cobra tie clamp). The breathing hose 140 may also be in fluid communication with a muffler housing block 150, for example with its bottom end connected to the muffler housing block 150 and held to the muffler housing block 150 with a clamp 155. The muffler housing block 150 may connect the breathing hose 140 to an external air source which may supply pressurized breathable air to the respirator system 100. In an embodiment, the respirator system 100 may also comprise a hood 130 to be worn by a user and a protective cover 135 which may removably connect to and cover a portion of the facemask 120, wherein the portion of the facemask 120 covered by the protective cover 135 may include the inhalation valve 110, the swivel assembly 145 of the breathing hose 140, and/or one or more optional filter cartridges 125 (such that the removable cover 135 may shield these elements from the abrasive blasting environment). The facemask 120 may also comprise an exhalation valve 115, which, in an embodiment, may also be covered by the protective cover 135. The protective cover 135 may for example protect the elements of the respirator from direct impact, for example from blowback, from an abrasive blasting grit material. It should be understood that the embodiment of FIG. 1A is merely exemplary, and in other embodiments the inhalation valve 110, exhalation valve 115, and/or filters 125 may be optional and/or may be located in other positions (for example under the hood 130 and/or off of the facemask 120). Further, the protective cover 135 may be an optional element in some embodiments, for example depending upon the location of other elements.

Figure 1B:
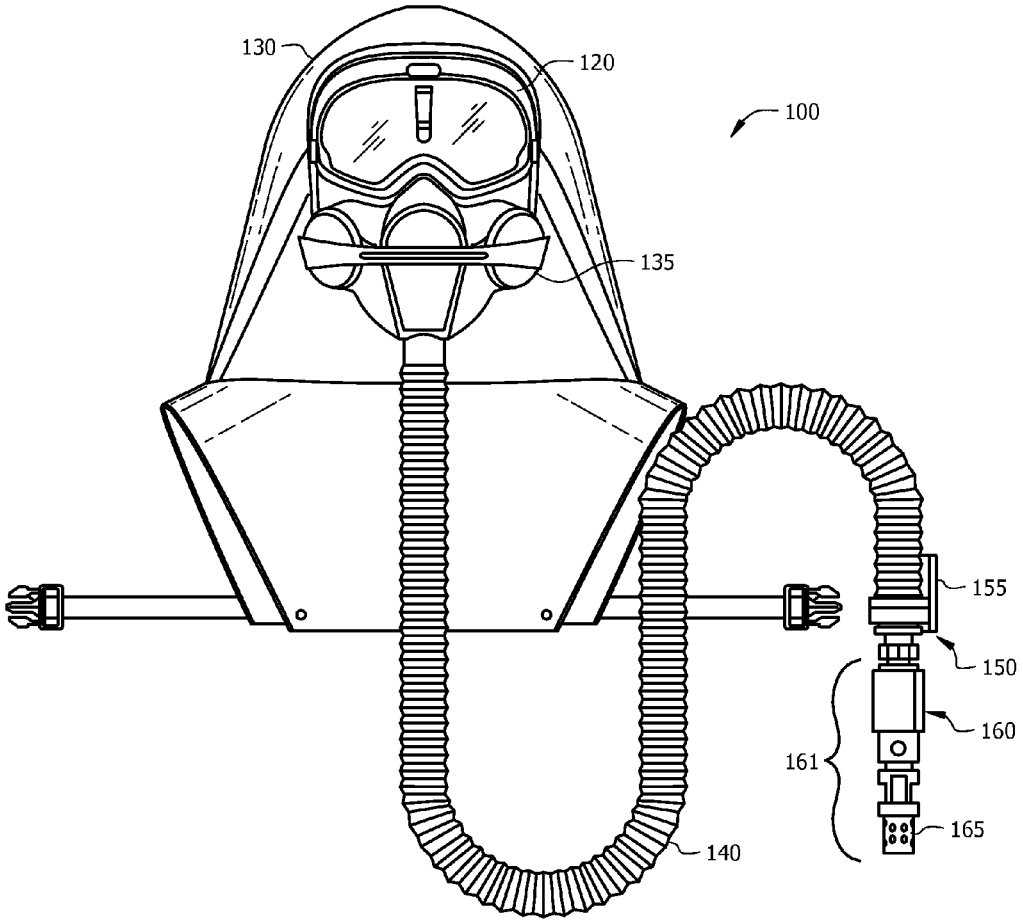

In the embodiment shown in FIG. 1B, the respirator system 100 may also comprise an optional cooling and/or heating element for supplied-air (e.g. VORTEX™ 160) coupled to the muffler housing 150, and the VORTEX™ 160 may then connect to an external air supply, for example, an air supply line. However, in other embodiments, the muffler housing 150 may directly connect to the external air supply without the VORTEX™ 160. In an embodiment, the VORTEX™ 160 may be operable to cool and/or heat the air that is provided through the breathing hose 140 to a user, and also may allow for adjustment of the air flow rate through the breathing hose 140. While such a VORTEX™ 160 device clearly may provide benefit to a user of the respirator, unfortunately, the VORTEX™ 160 may generate additional noise. Consequently, the noise impact of the VORTEX™ 160 may outweigh its comfort benefits in some contexts. Applicants have therefore developed noise reduction system embodiments to attempt to reduce noise levels association with use of a VORTEX™.

FIG. 1A illustrates an embodiment wherein a noise reduction system 105 may be incorporated into the respirator system 100, operable to reduce the noise created by air flow through the system 100, for example. This noise reduction system 105 may comprise different elements within the respirator, for example within the inhalation valve 110, the breathing hose 140 and/or the muffler housing block 150, and may in some embodiments comprise any one such element or any combination of one or more of the described elements. In an exemplary embodiment, the inhalation valve 110 may comprise a porous airflow element which may alter the air flow through the inhalation valve 110 without substantially restricting airflow. The porous airflow element may affect the turbulence of the air flow in a way to reduce the noise created by the air flow (for example, by reducing turbulence in some embodiments). In some embodiments, the porous airflow element may be located in proximity to the outlet of the inhalation valve. In an embodiment, this porous airflow element may comprise nonwoven polyester such as a felt material (and in some embodiments, the nonwoven polyester fabric may comprise acrylic binder). In an embodiment, the breathing hose 140 may expand or lengthen under pressure and/or due to the changes in the air pressure in the hose 140. This expansion/lengthening may cause noise, such as a whistling, within the hose 140 due to the air movement in the hose 140, especially if the breathing hose 140 is corrugated (as is often customary to improve crush-proof qualities). Therefore, the breathing hose 140 of some embodiments may comprise a porous airflow element which may alter the air flow through the breathing hose 140 without substantially restricting airflow and may affect the turbulence of the air flow in a way to reduce the noise created by the air flow. In some embodiments, the porous airflow element of the breathing hose 140 may be similar to the porous airflow element located within the inhalation valve 110. In an embodiment, the porous airflow element within the breathing hose 140 may comprise a felt material which may be nonwoven polyester, for example (possibly with acrylic binder), and may be located in proximity to the interface between the breathing hose 140 and the muffler housing block 150. In other words, the porous airflow element typically might be located in the inlet of the breathing hose 140, to minimize turbulence in the breathing hose 140 and thereby reduce or eliminate noise generated within the breathing hose 140 (for example, the whistling described above). The muffler housing block 150 in some embodiments may comprise a porous muffler (which may for example comprise a porous plastic material) which may alter the air flow through the muffler housing 150 and may affect the turbulence of the air flow in a way as to reduce the noise created by the air flow at the outlet of the muffler housing block 150 for example. The porous muffler might also reduce transfer of noise from a VORTEX™ (or other, similar supplied-air cooling and/or heating elements) upstream to the breathing hose 140. In some embodiments, the muffler housing 150 may also be designed in such a way to create a smooth air flow path through the housing 150 and may in an embodiment have a straight flow path, in order to reduce noise generation within the housing 150. This type of flow path may be especially useful if the housing 150 comprise a pressure relief valve. In some embodiments, the housing 150 might comprise a resonance chamber, sized and shaped to reduce noise (for example, using wave interference cancellation).

Additionally, the inhalation valve 110 of some embodiments may comprise a design operable to reduce fluttering within the valve, and in some embodiments, the VORTEX™ might be located in a housing comprising a muffler. These and other features will be described in more detail in the following figures.

Figure 2A:
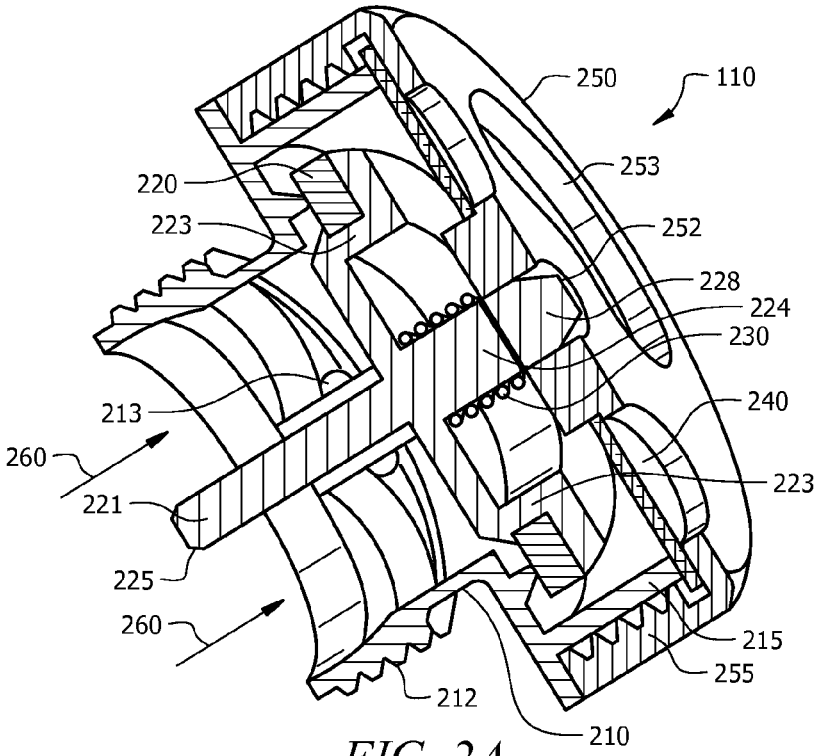
FIGS. 2A-2B illustrate two views of an inhalation valve of a respirator having an exemplary component of a noise reduction system according to an embodiment of the disclosure.
Figure 2B:
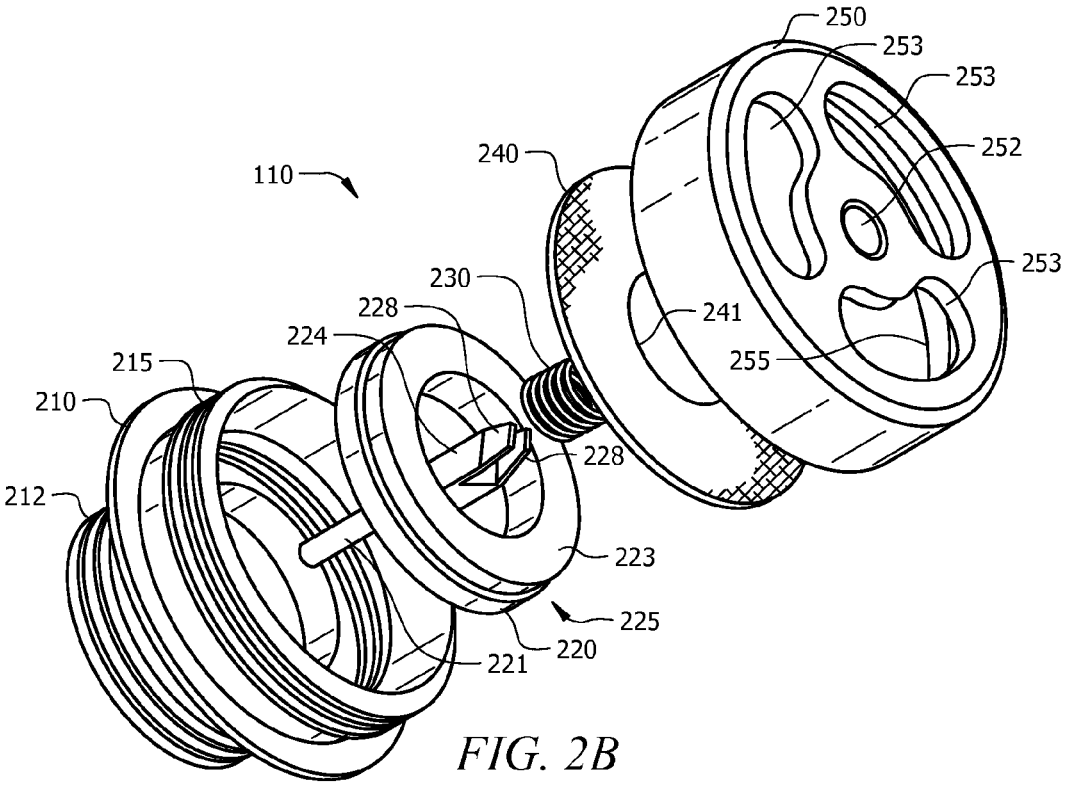

As seen in the exemplary embodiment of FIGS. 2A-2B, the inhalation valve 110 may typically comprise a housing 210, a stem 225, a rubber seal 220, a spring or other biasing member 230, and a cover 250. In the embodiment shown, the stem 225 may comprise: an elongated, thin section 221 operable to fit and slide within an opening in the housing 210; a wide, circular section 223 operable to hold the rubber seal 220 (for example, via one or more lips or grooves); and a section 224 comprising two prongs 228 that fit within an opening 252 of the cover 250. The prongs 228 may be operable in some embodiments to prevent fluttering of the valve 110 by pressing against the walls of the opening 252 in the cover 250 and/or maintaining contact with the walls of the opening 252 when the stem 225 and rubber seal 220 move between closed, partially open, or fully open positions. The spring 230 may bias the stem 225 and rubber seal 220 towards a closed position, in which the rubber seal 220 would block the air flow 260. In the embodiment of FIG. 2A, the spring 230 may fit around the prongs 228 of the stem 225 and press between the wide circular portion 223 of the stem 225 and the cover 250. The rubber seal 220 may contact at least a portion of the housing 210 when the valve 110 is in a closed position, as shown in the embodiment of FIG. 2A. When the inhalation valve 110 is installed within a respirator system 100 (for example, on a facepiece 120, as shown in FIG. 1A) and attached to a breathing hose 140, the cover 250 may be directed toward the user (i.e. the interior of the facepiece 120), and the housing 210 may attach to the breathing hose 140 via threads 212 (wherein the swivel assembly 145 may connect to the threads 212, for example). Therefore the air flow 260 may come from the breathing hose 140, through the valve 110, and into the facepiece 120. This configuration may allow for the valve 110 to be in an open position caused by the pressure from the air flow 260 through the breathing hose. In a situation wherein the pressure through the breathing hose is significantly lowered, such as if the breathing hose is punctured, removed, or compromised for example, the spring 230 might bias the stem 225 and rubber seal 220 into a closed position, which might prevent unwanted air from reaching a user, for example through a puncture in the hose.

In an embodiment, the inhalation valve 110 of the respirator may comprise a porous airflow element 240 operable to reduce the noise caused by the air flow through the valve 110. In an embodiment, the porous airflow element 240 may alter the air flow 260 through the inhalation valve 110 and may affect the turbulence of the air flow 260 in a way to reduce the noise created by the air flow 260. For example, the porous airflow element 240 may reduce the turbulence of the air flow 260 exiting the inhalation valve 110 in some embodiments. Typically, the porous airflow element 240 might be located at or in proximity to the outlet of the inhalation valve 110 (for example openings 253). Typical airflow through the porous airflow element might be about 5.0 to 10 CFM (cubic feet per minute). And in some embodiments, the porous airflow element 240 may comprise a felt material (which may be nonwoven polyester, for example). In one embodiment, the porous airflow element 240 may reduce the turbulence of the air flow 260 through the inhalation valve 110 without unduly restricting the air flow 260 so as not to affect the breathing ability of a user. In other words, the porous airflow element 240 may alter the air flow 260 in a way to reduce the noise caused by the turbulence of the air flow 260 (for example, by changing the airflow pattern), but typically would not restrict air flow 260 so much that the ability of a user to breathe is restricted or compromised. For example, the user typically should be able to breathe using the respirator without laboring. In an embodiment, the respirator system 100 may be required to meet standards or requirements (such as those set forth by the NIOSH) for the inhalation and exhalation resistance of the system. The porous airflow element 240 may, in an embodiment, fit within the cover 250 of the valve 110. The cover 250 may then attach to the housing 210 via threads 255 in the cover 250 and threads 215 in the housing 210. In an embodiment, a portion of the housing 210 may hold the porous airflow element 240 in place against the cover 250. The housing 210 may comprise one or more openings 213 to allow for air flow 260 through the valve 110, and the cover 250 may also comprise one or more openings 253 to allow for air flow 260 through the valve 110 to the user. In an embodiment, the porous airflow element 240 may comprise an opening 241 to allow for the stem to move within the opening 252 of the housing 250. The opening 241 of the porous airflow element 240 may also allow the porous airflow element 240 to fit over a portion of the cover 250. Typically, the porous airflow element 240 may be seated in the cover 250 so that air flowing though the openings 253 out of the inhalation valve 110 must first pass through the porous airflow element 240.

Figure 3A:
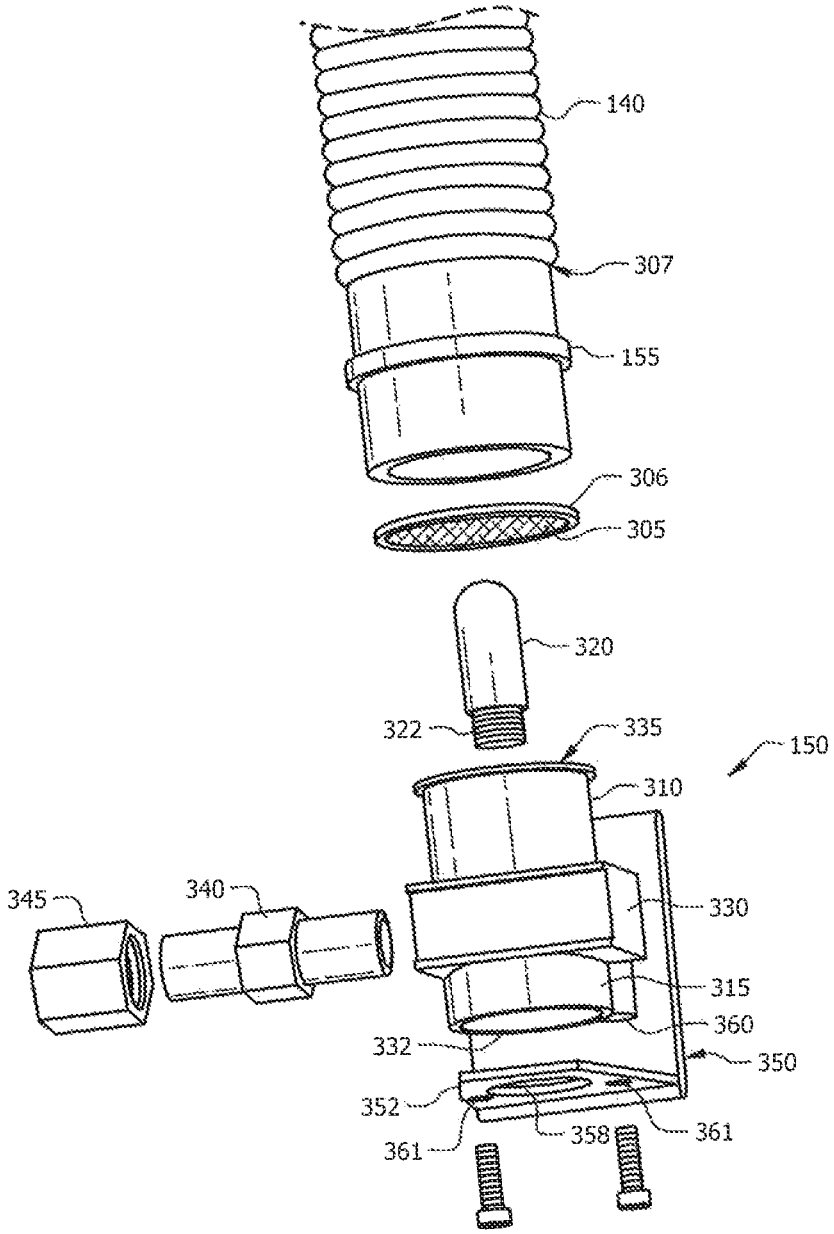
FIG. 3A illustrates an exploded view of a muffler housing block and a breathing hose according to an embodiment of the disclosure.
Figure 3B:
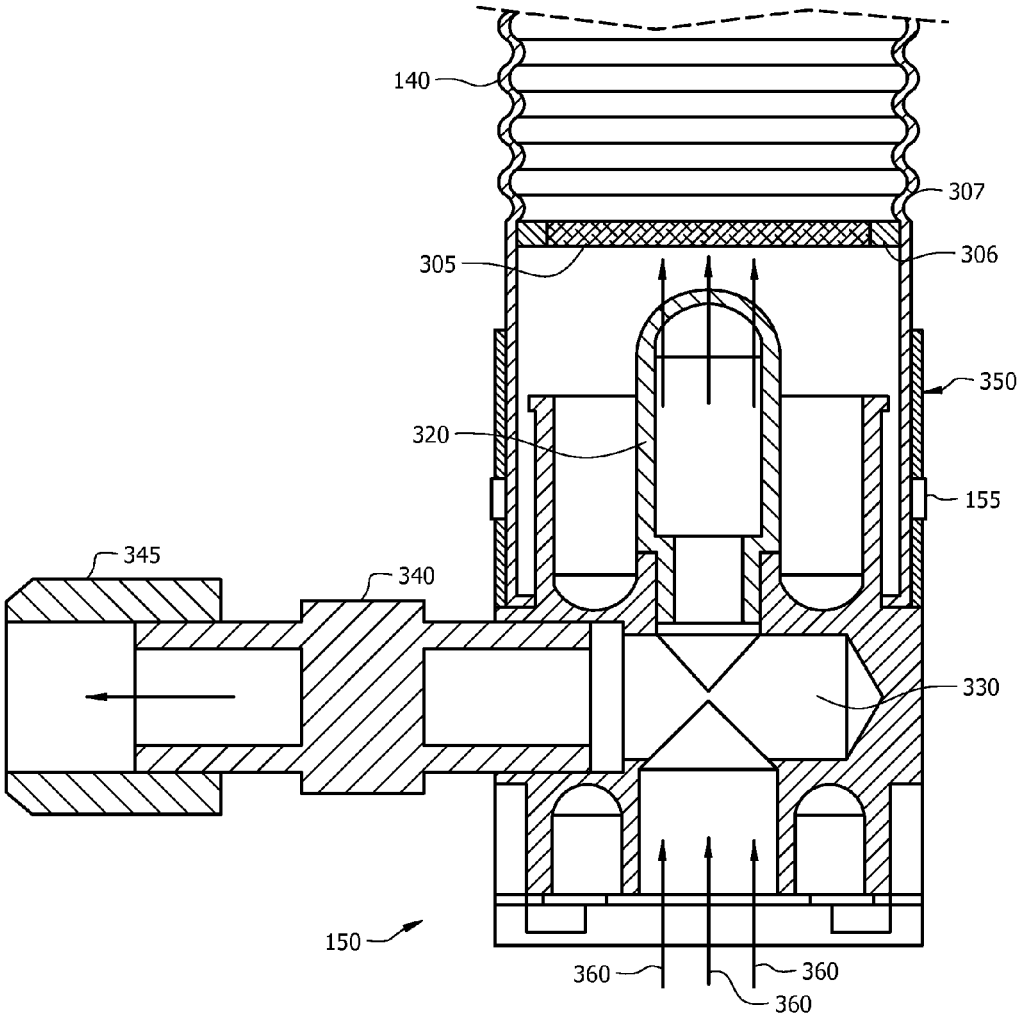
FIG. 3B illustrates a cross-sectional view of a muffler housing block in connection with a breathing hose according to an embodiment of the disclosure.
Figure 3C:
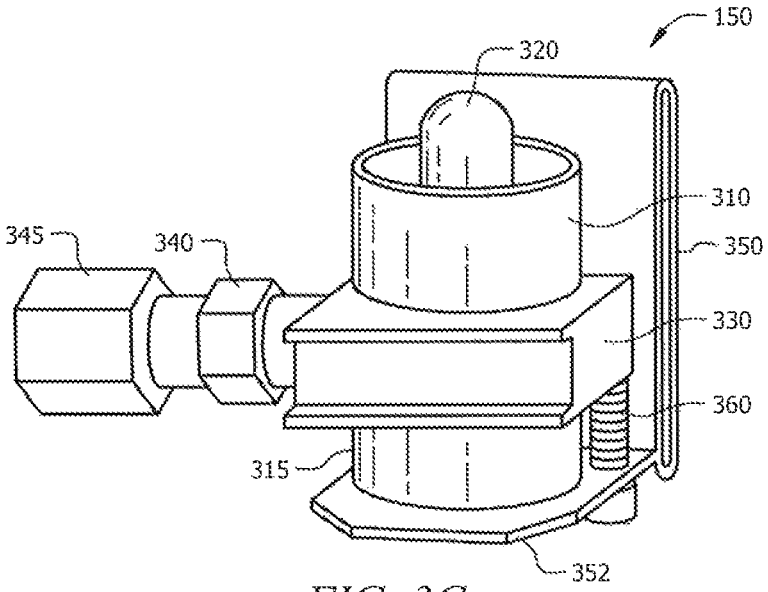
FIG. 3C illustrates a perspective view of a muffler housing block according to an embodiment of the disclosure.

FIGS. 3A-3D show various detailed views of an exemplary muffler housing block 150. In FIGS. 3A and 3B, the connection between the muffler housing 150 and the breathing hose 140 is shown, wherein the hose 140 may fit over a shroud portion 310 of the housing 150 and may be held in place against the housing 150 with a clamp 155 (which may be optionally adjustable and/or removable, such that the breathing hose 140 could be repeatedly attached to or removed from the muffler block housing 150). The breathing hose 140 of FIG. 3A is corrugated for most of the length (although a portion at one or more of its ends may be smooth). In an embodiment, the breathing hose 140 may comprise a porous airflow element 305 located within the hose 140 (typically near the inlet to the breathing hose 140) which may alter the air flow 360 through at least a portion of the breathing hose 140 and may affect the turbulence of the air flow 360 (without substantially restricting air flow) in a way to reduce the noise created by the air flow 360. For example, the porous airflow element 305 may reduce the turbulence of the air flow 360 through the breathing hose 140. The porous airflow element 305 may comprise a felt material (which may be nonwoven polyester). In an embodiment, the porous airflow element 305 may be similar to the porous airflow element 240 discussed above with respect to the inhalation valve 110 (shown in FIGS. 2A-2B). As shown in FIGS. 3A-3B, the porous airflow element 305 may be located in proximity to the connection between the breathing hose 140 and the muffler housing 150, and may in some embodiments, fit into a ridge or groove 307 in the interior of the hose 140 (for example, in an embodiment, the felt element 305 may fit in the smooth end of the hose 140 and be held in place by contact with the corrugated surface 307). In one embodiment, the porous airflow element 305 may include a stabilizing ring 306 about its perimeter (which may in some embodiments be made of plastic material) operable to structurally support and hold the porous airflow element 305 in place within the hose 140. For example, the porous airflow element 305 may fit within the stabilizing ring 306 and may be held by adhesive, and/or fits within a groove/cutout within the ring, and/or is joined by ultrasonic welding. The porous airflow element 305 may reduce the turbulence of the air flow 360 through the breathing hose 140 without unduly restricting the air flow 360 so as not to affect the breathing ability of a user.

Figure 3D:
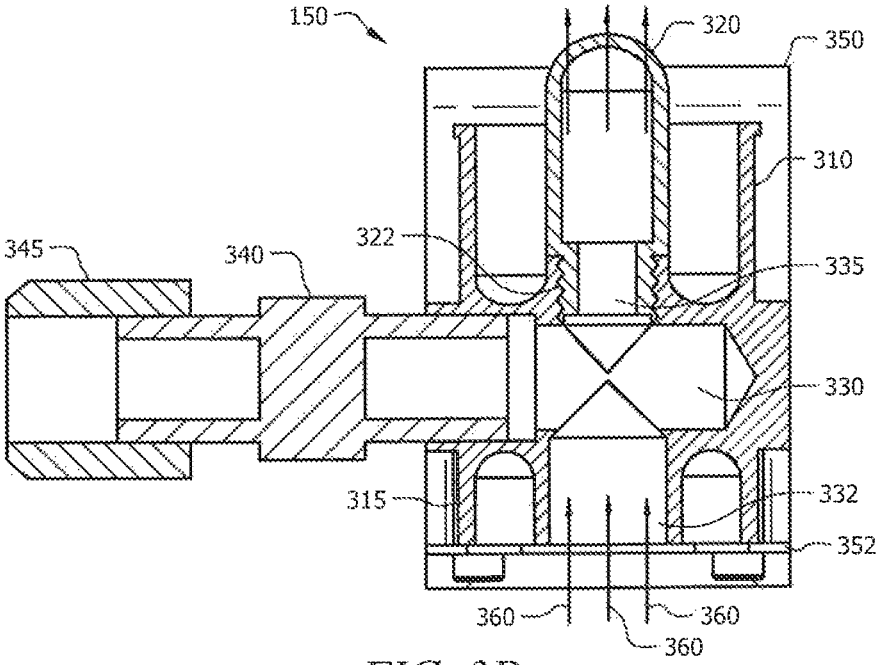
FIG. 3D illustrates a cross-sectional view of a muffler housing block according to an embodiment of the disclosure.

As shown in FIGS. 3A-3D, the muffler housing block 150 may comprise a chamber 330 with an inlet 332 and an outlet 335, wherein the inlet 332 may provide connection with an air supply and, in some embodiments, may connect to a VORTEX™ 160 (as shown in FIG. 1B). The chamber 330 may be designed to allow for a smooth or straight air flow pathway through the chamber 330, further reducing the noise created by the air flow 360. Such a pathway may be particularly advantageous in embodiments having a pressure relief valve 340 located within the housing block 150. As can be seen in FIG. 3D, the air flow 360 may come into the housing 150 through the inlet 335 of the chamber 330, flow through the chamber 330, and then through the outlet 332 into the breathing hose 140. In the embodiment shown, the air may flow through a porous muffler 320 at the outlet 332 (which may in some embodiments comprise a porous plastic material) wherein the porous muffler 320 may further reduce noise created by the air flow 360, for example. The porous muffler 320 may be held to the outlet 332 of the chamber 330 by threads 322. In the embodiment of FIG. 3D, the porous muffler 20 may completely cover the outlet 332, such that at least most of the air flow 360 through the chamber 330 may he directed through the porous muffler 320 (prior to entering the breathing hose 140, for example). The porous muffler 320 may reduce the turbulence of the air flow 360 through the muffler housing block 150 without unduly restricting the air flow so as not to affect the breathing ability of a user and/or otherwise minimize noise association with the housing block 150 and/or the VORTEX™. In an embodiment wherein a VORTEX™ is attached to the muffler block housing 150 (as shown in FIG. 1B), the porous muffler 320 may also reduce transmission of any noise created by the VORTEX™. In an embodiment, the porous muffler 320 may typically comprise sintered plastic, typically polypropylene, HDPE, PC, etc., which may typically have a pressure drop of approximately 3.5 to 4.5 PSIG at 5 CFM.

In an embodiment, the muffler housing 150 may comprise a lower shroud 315 at the inlet 335 of the chamber 330 and an upper shroud 310 at the outlet 332 of the chamber 330. The lower shroud 315 may be operable to protect the inlet 335, for example from direct impact of blasting grit material, and/or to allow for attachment of larger diameter elements despite a smaller diameter inlet 335. The upper shroud 310 may be operable to protect the outlet 332 of the chamber 330 and the porous piece 320, for example from direct impact of blasting grit material, and/or allow for attachment of larger diameter breathing hose despite a smaller diameter outlet 332. Additionally, the hose 140 may fit over the upper shroud 310 and further protect the outlet 332 and the porous piece 320.

In an alternative embodiment, the chamber 330 of the muffler block housing 150 may be expanded to create a resonating chamber that may provide noise reduction effects. The chamber might be sized and shaped to employ passive noise cancellation techniques. This expanded chamber 330 could be designed or tuned to reduce the noise from the air flow 360 through the chamber 330, and in some embodiments, more than one resonating chamber could be used. Also, in some embodiments, the chamber might include one or more baffles for noise reduction. Optionally, a porous muffler element 320 might be used in conjunction with such a chamber. However, the embodiment that combines a porous muffler 320 and a smaller chamber 330 may typically be preferred because of the decreased weight and bulk of such a muffler housing block 150.

In an embodiment, the muffler housing block 150 may comprise a pressure relief valve 340 which may attach to a side of the chamber 330 between the inlet 335 and outlet 332. In an embodiment, the location of the pressure relief valve 340 with respect to the chamber 330 (as shown in FIGS. 3A-3D) may allow for the straight/smooth air flow path through the chamber 330. The pressure relief valve 340 may further connect to a breathing vent 345, wherein the pressure relief valve 340 may allow air to flow through the valve 340 and the vent 345 if the pressure within the chamber 330 increases above a specified pressure (which may be specified at a value to avoid a pressure in the breathing hose 140 that may cause it to burst). In an embodiment, the muffler housing block 150 may also comprise a belt clip 350 attached to the housing block 150 to allow the block 150 to be held by a belt that may be worn by a user of the respirator system. The belt clip 350 may be attached to the chamber 330 near the lower shroud 315 and the belt clip 350 may comprise an extended lip 352 which may fit against the lower shroud 315. The lip 352 of the belt clip 350 may comprise a plurality of holes, wherein hole 358 may allow access to the inlet 335 of the chamber 330 and holes 361 may allow for screws 335 to attach the lip 352 to the chamber 330 via receiving holes 360.

In an embodiment, the porous airflow element 240 of the inhalation valve 110 (as shown in FIGS. 2A-2B) and the porous airflow element 305 of the breathing hose 150 (as shown in FIG. 3A) may comprise a nonwoven polyester with acrylic binder, for example, such as felt fabric. In the embodiments described above, the porous airflow elements may alter the air flow pattern though the noise reduction system. The porous airflow elements may reduce the turbulence of the air flow without unduly restricting the air flow such that the air flow is sufficient for a user of the respirator system to breathe without significant effort. In an alternative embodiment, the porous airflow elements may comprise an open cell foam material providing comparable airflow alteration without substantially restricting airflow. In an embodiment, the porous airflow elements may optionally be operable to absorb or otherwise attenuate the sound or noise, or additional noise absorption elements might otherwise be incorporated into the noise reduction system. In the embodiment wherein the porous airflow element comprises a felt material, the porous airflow element may comprise a thickness of about 0.040 to 0.060 inch and air permeability of about 220 to 400 CFM/Sq. ft. at 0.5 inch H2O.

In some embodiments, the VORTEX™ 160 may be located/retained within a VORTEX™ housing 161, as shown in FIG. 1B. The VORTEX™ housing 161 may comprise a muffler element 165, typically located at the far (distal) end away from the user, operable to disperse and/or direct away from the user noise generated by the VORTEX™ 160, for example exhaust noise. Such a VORTEX™ assembly muffler 165, while optional, may further improve noise concerns.

Embodiments of the disclosure may also relate to methods of assembling a noise reduction system for use with a supplied air respirator and methods of assembling elements within a noise reduction system. Embodiments of the disclosure may include any combination of one or more of the described elements and assemblies. In an embodiment, a face mask or facepiece of a respirator may be provided, wherein the facepiece comprises an inhalation valve. The facepiece may be incorporated into a supplied air respirator system, which may optionally comprise a hood and/or eye protection as well as other protective elements. The inhalation valve of the facepiece may comprise a porous airflow element (which may for example be a felt material) operable to reduce noise due to air flow in the inhalation valve. The inhalation valve may be connected to a breathing hose and further connected to an air supply to provide breathable air to a user when wearing the facepiece of the respirator. In other embodiments, the inhalation valve may be independent of the facepiece, for example located away from the facepiece.

In another embodiment, a breathing hose may be provided wherein the hose may comprise a porous airflow element therein (which may for example be a felt material) operable to reduce noise due to air flow in the breathing hose. The breathing hose may then be incorporated into a supplied air respirator system, such as by attachment to a portion of a facepiece of the respirator system. An air supply may then be connected to the breathing hose to provide breathable air to a user, wherein the air from the air supply would be directed through the porous airflow element in the breathing hose. In an embodiment, the breathing hose may be attached to a facepiece comprising an inhalation valve, wherein the inhalation valve may comprise a porous airflow element (which may for example be a felt material) operable to reduce noise due to air flow in the inhalation valve. In other words, a noise reduction system may comprise a porous airflow element in a breathing hose as well as a porous airflow element in an inhalation valve.

In yet another embodiment, a muffler block housing may be provided wherein the muffler block housing comprises a porous muffler (which may for example comprise a porous plastic material) operable to reduce noise due to air flow through the muffler block housing. The muffler block housing may then be connected to one end of a breathing hose, which may then be incorporated into a supplied air respirator system, such as by attachment to a portion of a facepiece of the respirator system. An air supply may then be connected to the muffler block housing to provide breathable air to a user. In an embodiment, the breathing hose attached to the muffler block may comprise a porous airflow element therein (which may for example be a felt material) operable to reduce noise due to air flow in the breathing hose. In other words, a noise reduction system may comprise a porous airflow element in a breathing hose as well as a porous muffler in the muffler block housing. In another embodiment, the facepiece attached to the breathing hose may comprise an inhalation valve, wherein the inhalation valve may comprise a porous airflow element (which may for example be a felt material) operable to reduce noise due to air flow in the inhalation valve. In other words, a noise reduction system may comprise a porous muffler in the muffler block housing as well as a porous airflow element in an inhalation valve. In yet another embodiment, the noise reduction system may comprise a porous muffler in the muffler block housing, a porous airflow element in an inhalation valve, and a porous airflow element in a breathing hose.

In an embodiment, an inhalation valve comprising a porous airflow element may be assembled, wherein a housing and a cover may be provided. A stem comprising a rubber seal may also be provided and fitted within the housing, and a spring or other biasing member may also be provided and fitted against the stem. The porous airflow element may be fitted within the cover of the valve, such that the stem may pass through an opening in the cover. Then, the cover may be attached to the housing, containing the above described elements therein, such that the stem may be operable to move within the housing and any air flow through the valve may be directed through the porous airflow element.

In another embodiment, a breathing hose comprising a porous airflow element may be assembled, wherein the porous airflow element may be placed within a stabilizing ring (which may for example comprise a plastic material) and then fitted within the breathing hose. In an embodiment, the breathing hose may comprise a ridge or groove operable to hold the porous airflow element and stabilizing ring. The ridge or groove may, in an embodiment, be located in proximity to one end of the breathing hose, wherein that end may be connected to a muffler block housing and/or an air supply.

In yet another embodiment, a muffler block housing comprising a porous muffler (which may for example comprise a porous plastic material) may be assembled, wherein the porous muffler may be located at an outlet of the muffler block housing. The muffler block housing may comprise a chamber with an inlet and an outlet. The housing may be formed such that upper and lower shroud sections may surround the inlet and outlet of the chamber. Additionally, a pressure relief valve may at a first end be connected to a side of the chamber, wherein the pressure relief valve further connects at a second end to a breathing vent. The chamber may be formed such that air may flow in a smooth or straight path through the chamber (despite the presence of a pressure relief valve). The porous muffler may then be attached to the outlet of the chamber via threading and the upper shroud section may surround at least a portion of the porous muffler when it is attached to the outlet of the chamber.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled of communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A supplied air respirator system comprising:

a supplied-air inhalation valve comprising a porous airflow element which alters the air flow through the valve to reduce noise without substantially restricting airflow;

a breathing hose in fluid communication with the inhalation valve; and a muffler housing block in fluid communication with a bottom end of the breathing hose;

wherein:

the inhalation valve is biased towards a closed position and operable to open under supplied-air pressure from the breathing hose;

the inhalation valve further comprises a stem and a cover, wherein the cover comprises a stem opening and one or more outlet openings, and at least a portion of the stem is located within the stem opening and is designed to maintain contact with the cover throughout movement of the valve to avoid fluttering of the valve;

the porous airflow element of the inhalation valve is located within the valve in proximity to the one or more outlet opening in the cover;

the breathing hose comprises a porous airflow element located within the breathing hose in proximity to the interface of the hose and the muffler housing block, wherein the porous airflow element of the breathing hose alters the air flow through the hose to reduce noise without substantially restricting airflow;

the muffler housing block comprises a muffler comprising porous plastic muffler material;

the muffler housing block comprises a chamber designed to allow for a substantially straight air flow path through the muffler housing block and a pressure relief valve in fluid communication, with the chamber; and the porous airflow elements alter the air flow to minimize turbulence without substantially restricting airflow, thereby reducing noise created by the air flow.

2. The system of claim 1 wherein the porous airflow element of the inhalation valve comprises a felt material formed of nonwoven polyester.

3. The system of claim 1 wherein the porous airflow element of the breathing hose comprises a felt material formed of nonwoven polyester.

4. The system of claim 1 wherein the inhalation valve is located on a facepiece of the respirator, and wherein the stem of the inhalation valve comprises a plurality of prongs pressing outward within the stem opening the cover to maintain contact between the stem and the cover to reduce fluttering of the inhalation valve during operation.

5. A supplied air respirator system comprising:

an inhalation valve biased towards a closed position and operable to open under supplied-air pressure from breathing hose; and a corrugated breathing hose in fluid communication with the inhalation valve;

wherein:

the inhalation valve closes if supplied-air through the breathing hose is compromised;

the inhalation valve comprises a felt element which alters the air flow through the valve without substantially restricting airflow; and the breathing hose comprises a felt element within the breathing hose which alters the air flow through the breathing hose without substantially restricting airflow.

6. The system of claim 5 further comprising a muffler housing block in fluid communication with the breathing hose, wherein the muffler housing block comprises a porous plastic muffler.

7. The system of claim 6 wherein the felt element of the breathing hose is located in proximity to the interface of the muffler housing block and the breathing hose.

8. The system of claim 6 wherein the porous plastic muffler comprises a sintered plastic muffler material which has a working pressure up to about 200 PSIG and pressure drop of about 3.5 to 4.5 PSIG at 5 cubic feet per minute.

9. The system of claim 5 further comprising a muffler housing block in fluid communication with the bottom of the breathing hose, wherein the muffler housing block comprises at least one resonating chamber therein tuned to reduce noise and a pressure relief valve in fluid communication with the chamber.

10. The system of claim 5 wherein the felt elements alter the airflow to reduce the turbulence of the air flow, thereby reducing the noise caused by the air flow.

11. The system of claim 5 wherein the inhalation valve further comprises a stem and a cover, wherein the cover comprises a stem opening, and at least a portion of the stem is located within the stem opening and is operable to maintain contact with the cover throughout movement of the valve to avoid fluttering of the valve.

12. The system of claim 5 wherein the felt elements of the inhalation valve and the breathing hose comprise a nonwoven polyester material having a thickness of about 0.040 to 0.060 inch and an air permeability of about 220 to 400 CFM/sq. ft. at 0.5 inch H2O.

13. A supplied air respirator comprising:

an inhalation valve; and a breathing hose in fluid communication with the inhalation valve;

wherein:

the inhalation valve is biased to close if supplied-air through the breathing hose is compromised;

the inhalation valve comprises a porous airflow element within the valve which alters the air flow through the valve without substantially restricting airflow; and the breathing hose comprises a porous airflow element within the breathing hose which alters the air flow through the breathing hose without substantially restricting airflow.

14. The respirator of claim 13; wherein the inhalation valve further comprises a cover having one or more outlet opening; and wherein the porous airflow element of the inhalation valve is located in proximity to the one or more outlet openings in the cover.

15. The respirator of claim 14 wherein the inhalation valve is located on a facepiece of the respirator.

16. The respirator of claim 15 wherein the porous airflow element of the inhalation valve comprises a felt material formed of nonwoven polyester.

17. The respirator of claim 13 wherein the porous airflow element of the breathing hose comprises a felt material formed of nonwoven polyester.

18. The respirator of claim 13 further comprising a muffler housing block in fluid communication with a bottom end of the breathing hose, wherein the muffler housing block comprises an outlet and a muffler located at the outlet and comprising a porous plastic muffler material.

19. The respirator of claim 18 wherein the muffler housing block further comprises a chamber designed to allow for a substantially straight air flow path through the muffler housing block and a pressure relief valve in fluid communication with the chamber; wherein the chamber is a resonating chamber tuned to reduce noise.

20. The respirator of claim 13 wherein the inhalation valve further comprises a stem and a cover, wherein the cover comprises a stem opening, and at least a portion of the stem is located within the stem opening and is operable to maintain contact with the cover throughout movement of the valve to minimize fluttering of the valve.

* * * * *